US010559201B1

(12) United States Patent
Bauer et al.

(10) Patent No.: US 10,559,201 B1
(45) Date of Patent: Feb. 11, 2020

(54) USING CONNECTED VEHICLE DATA TO OPTIMIZE TRAFFIC SIGNAL TIMING PLANS

(71) Applicant: TRAFFIC TECHNOLOGY SERVICES, INC., Beaverton, OR (US)

(72) Inventors: Thomas Bauer, Beaverton, OR (US); Jingtao Ma, Portland, OR (US)

(73) Assignee: TRAFFIC TECHNOLOGY SERVICES, INC., Beaverton, OR (US)

( * ) Notice: Subject to any disclaimer, the term of this patent is extended or adjusted under 35 U.S.C. 154(b) by 0 days.

(21) Appl. No.: 16/268,352

(22) Filed: Feb. 5, 2019

Related U.S. Application Data

(60) Provisional application No. 62/635,688, filed on Feb. 27, 2018.

(51) Int. Cl.
*G08G 1/07* (2006.01)
*G08G 1/01* (2006.01)

(52) U.S. Cl.
CPC ..... *G08G 1/07* (2013.01); *G08G 1/0145* (2013.01)

(58) Field of Classification Search
CPC ..... G08G 1/07; G08G 1/082; G08G 1/09; G08G 1/08; G08G 1/087; G08G 1/01; G08G 1/166
See application file for complete search history.

(56) References Cited

U.S. PATENT DOCUMENTS

| | | | | |
|---|---|---|---|---|
| 9,412,271 | B2 * | 8/2016 | Sharma | G08G 1/052 |
| 2011/0037619 | A1 * | 2/2011 | Ginsberg | G08G 1/095 340/910 |
| 2011/0095908 | A1 * | 4/2011 | Nadeem | B60H 3/00 340/905 |
| 2011/0169661 | A1 * | 7/2011 | Eichhorst | G08G 1/087 340/906 |
| 2015/0310737 | A1 * | 10/2015 | Simanowski | G08G 1/081 340/910 |

* cited by examiner

*Primary Examiner* — Toan N Pham
(74) *Attorney, Agent, or Firm* — FisherBroyles, LLP; Micah Stolowitz

(57) ABSTRACT

A fleet of vehicles ("connected vehicles") are equipped to wirelessly transmit data in real time, the data including at least an identifier of the vehicle, a GPS location, and a timestamp. Preferably, messages may be sent from the vehicles approximately once per second. This "probe data" from operating vehicles is analyzed to assemble vehicle operation data over a collection period of say, a few weeks. The data is analyzed for a specific signalized intersection. In an embodiment, a preferred process is to leverage the connected vehicle probe data to figure out the traffic volume for a target time period and location, and then optimize the corresponding timing plan for that time period for the subject signal/lane/phase. Target time periods may be on the order of 15 minutes, 30 minutes or an hour, although the exact time period is not critical.

21 Claims, 6 Drawing Sheets

USING CONNECTED VEHICLE DATA TO OPTIMIZE TRAFFIC SIGNAL TIMING PLANS

RELATED APPLICATION

This application is a non-provisional of U.S. Provisional Application No. 62/635,688, filed Feb. 27, 2018. The provisional application is hereby incorporated by reference in its entirety.

COPYRIGHT NOTICE

© 2018-2019 Traffic Technology Services, Inc. A portion of the disclosure of this patent document contains material which is subject to copyright protection. The copyright owner has no objection to the facsimile reproduction by anyone of the patent document or the patent disclosure, if and when it appears in the Patent and Trademark Office public records, but otherwise reserves all copyright rights whatsoever. 37 CFR § 1.71(d).

TECHNICAL FIELD

This application pertains to traffic engineering and, more specifically, to optimizing traffic signal timing plans based on connected vehicle probe data to improve performance at signal-controlled intersections and other locations.

BACKGROUND

Automated traffic signals are operated by electronic field signal controllers according to a signal timing plan for each controlled location, such as an intersection of two streets. The timing plans are developed in part by traffic volume counting, for example, and often they are very outdated, and therefore cause undue delay of vehicle-users of the intersection among other problems. The need remains for better optimized traffic signal timing plans to reduce delay and the concomitant wastes of time and energy expended when vehicles are unduly delayed at an intersection.

Glossary: Some of the terms used herein may be defined as follows.

Traffic Signal or simply "Signal". Refers to a set of traffic control devices (hardware and software) generally deployed at a single street intersection, highway ramp or other location. A traffic signal is controlled by an associated Field Signal Controller ("FSC").

Field Signal Controller ("FSC"). Refers to a controller, generally comprising electronics and/or software, arranged to control a Traffic Signal. The Field Signal Controller may be located at or near the corresponding Traffic Signal location, such as a street intersection, or at a central traffic management center, or some combination of the two. An FSC may operate according to various rules, algorithms, and inputs, depending on the location and circumstances of the signal it controls. The traffic signal controller that acts as the "brains" of the traffic signal. The controller tells the signal what to run, how long to run, when to run, etc. The controller collects information from the intersection through the detection system, decides how to respond, and then tells the vehicle and pedestrian displays or "indicators" how to operate.

Field Signal Controller State. Refers to the state of an FSC, for example, the status of one or more internal timers, and the state or status of one more "indicators" (see below), controlled by the FSC such as vehicle displays. The FSC has a given state at a specific time.

Cycle Time or Cycle Length. An FSC may change state according to a Cycle Time, although the cycle time may not always be constant. For example, a weekday cycle time may differ from a weekend cycle time for a given FSC. The cycle time generally, for a fixed schedule timing plan, is the time to cycle through all of the states of the timing plan. More detail is provided later.

Detector. Refers to an electrical, magnetic, optical, video or any other sensor arranged to provide raw input signals to an FSC in response to detection of an entity such as a motor vehicle, transit vehicle, bicycle or pedestrian. The input signal may correspond to the arrival, presence, or departure of the vehicle. A detector also may be activated manually, for example, by a pedestrian or a driver pressing a button. Of course, a detector also may be initiated remotely or wirelessly, similar to a garage or gate opener. In general, Detectors provide raw inputs or stimuli to an FSC.

Indicator. Refers to one or more displays or other visible and/or audible indicators arranged to direct or inform a user such as a motor vehicle driver, bicyclist, pedestrian, or transit vehicle operator at or near a given traffic signal location. A common Indicator for motor vehicles is the ubiquitous Green-Yellow-Red arrangement of lights. Typically, an indicator is triggered or otherwise controlled by the FSC associated with the signal location.

Signal Timing Plan (or simply Timing Plan) refers to a plan or scheme that determines the sequence of operation, i.e. state changes, time periods (for example, red light and green light time periods) and various other parameters for controlling an intersection by operation of signals, while considering approaching and/or present vehicles, as well as time for pedestrians and other users. A timing plan generally is implemented in software code or a database, and the plan is utilized by an FSC to control its operations. So, as a very simple example, to increase the green time for a particular phase during rush hour, one would modify the signal timing plan for that intersection accordingly. Some traffic signals operate on a fixed schedule, while some others are "actuated" or may be adaptive to various conditions and/or detector inputs.

SUMMARY OF THE DISCLOSURE

The following is a summary of the present disclosure in order to provide a basic understanding of some features and context. This summary is not intended to identify key/critical elements of the present disclosure or to delineate the scope of the disclosure. Its sole purpose is to present some concepts of the present disclosure in a simplified form as a prelude to the more detailed description that is presented later.

In a preferred embodiment, the methods and systems of this disclosure enable leveraging connected vehicles to acquire "probe data" from the vehicles, in particular at selected signal-controlled intersections. The probe data is processed and used to optimize the signal timing plan for the selected intersection, and other purposes.

In one example, a method is described as: provisioning a fleet of vehicles to enable the vehicles each to wirelessly transmit probe data in real time, the probe data including, for a given vehicle, a series of probe messages, each probe message including at least an identifier of the vehicle, a GPS location, and a timestamp; receiving the transmitted probe data messages and storing the probe data carried by the received messages; processing the stored probe data to assemble vehicle usage data over a target time span for a selected electronic signal-controlled intersection, wherein the selected intersection is operating according to a corresponding signal timing plan; and adjusting the signal timing plan of the intersection, based on the vehicle usage data, to reduce overall delay of the intersection or achieve other objectives.

BRIEF DESCRIPTION OF THE DRAWINGS

In order to describe the manner in which the above recited and other advantages and features of the disclosure can be obtained, a more particular description follows by reference to the specific embodiments thereof which are illustrated in the appended drawings.

Understanding that these drawings depict only typical embodiments of the present disclosure and are not therefore to be considered to be limiting of its scope, the present disclosure will be described and explained with additional specificity and detail through the use of the accompanying drawings in which.

DETAILED DESCRIPTION OF PREFERRED EMBODIMENTS

Connecting vehicles to the traffic signal infrastructure is a new concept that promises to reduce fuel consumption and save time. We describe herein various methods and apparatus to accomplish this functionality. The embodiments described below are not intended to limit the broader inventive concept, but merely to illustrate it with some practical implementations. The ongoing improvements in related technologies, such as cloud computing, wireless data communications, vehicle head units, video, etc. will enable further embodiments in the future that may not be apparent today, but nonetheless will be equivalent variations on our disclosure, perhaps leveraging newer technologies to improve speed, lower cost, etc. without departing from our essential inventive concept.

Some communication infrastructure is necessary to deliver various "signal data" (for example, states, timers or predictions) into a (potentially moving) vehicle in real-time. Preferably, the vehicle (or its operator) not only is informed about the current status of the signal, but also what the signal is going to do in the near-term future. Predictions of traffic control signal status and or changes can be utilized to advantage by a vehicle control system, either autonomously or with driver participation. Predictions of traffic control signal status and or changes also can be utilized by a vehicle operator independently of a vehicle control system.

Some ways to generate traffic control signal predictions are described in our prior U.S. Pat. No. 9,396,657. Predictions of traffic control signal status and or changes may be delivered to a vehicle in various ways, for example, using the wireless telecom network, Wi-Fi, Bluetooth or any other wireless system for data transfer. Any of the above communication means can be used for communication to a vehicle, for example, to a "head unit" or another in-vehicle system, or to a portable wireless device, such as a driver or passenger's tablet computer, handheld, smart phone or the like. A user's portable device may or may not be communicatively coupled to the vehicle. For example, it is known to couple a mobile phone to a vehicle head unit for various reasons, utilizing wired or wireless connections.

Moving data in the opposite direction, suitably equipped vehicles (herein "connected vehicles") can transmit useful data, such as their location (GPS coordinates), speed, etc. over the wireless telecom infrastructure using standard protocols. In most modern vehicles (internal combustion, hybrid, electric or otherwise), on-board networks and processors have ready access to such data to include it in messages over a wireless channel. We refer to connected vehicle-generated data in general as "probe data." Connected vehicle probe data can be anonymized to protect user privacy. For present purposes, the identity of specific vehicles or drivers is not important.

Figure 1:
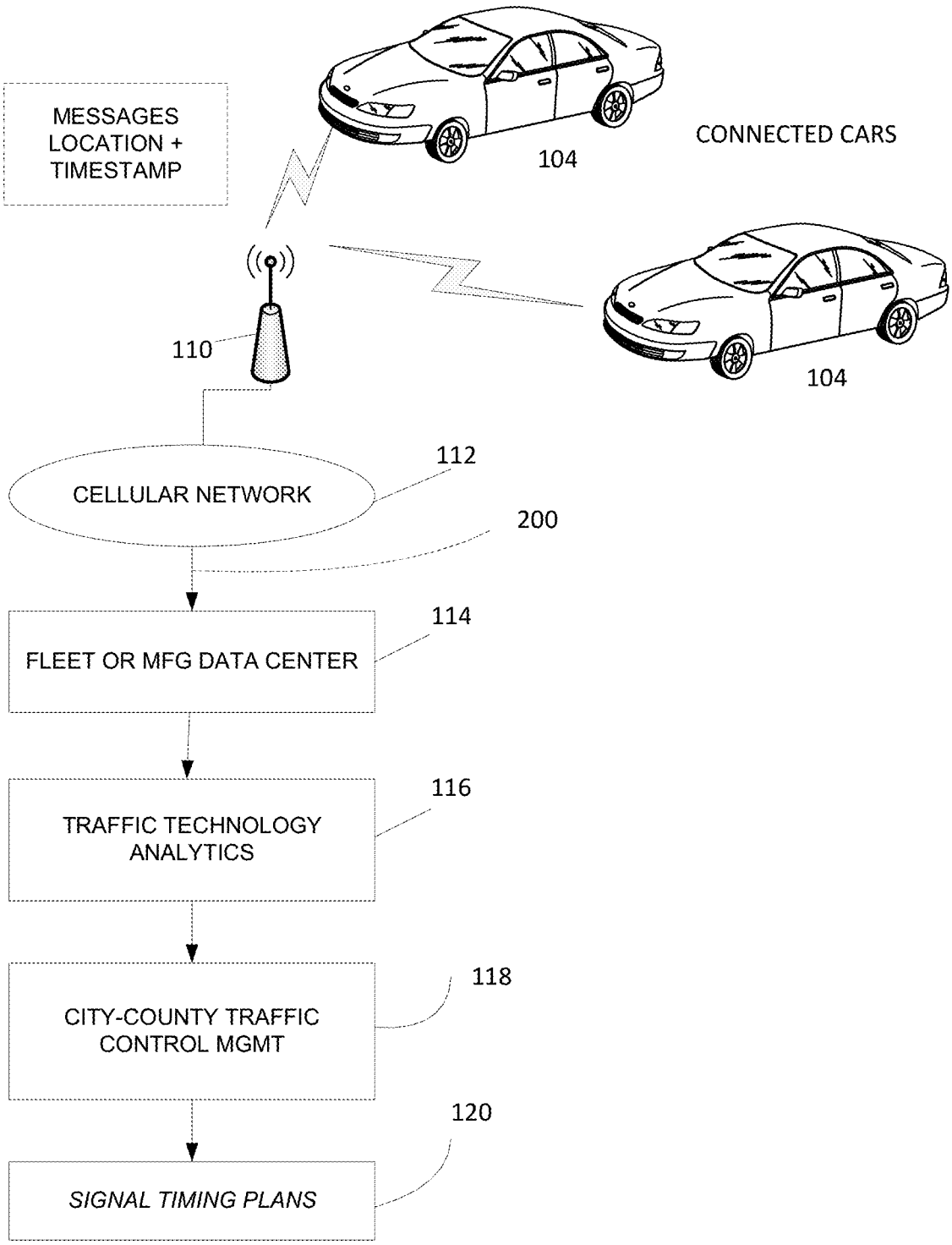
FIG. 1 is a simplified overview illustration of a system for optimizing traffic control timing plans.

FIG. 1 is a simplified overview illustration of an example system for optimizing traffic control timing plans as taught herein. In the figure, connected vehicles 104 are equipped to transmit messages containing probe data as described in more detail below. In practice, a fleet of hundreds or even thousands of vehicles may be so quipped for data collection. The probe data messages may be transmitted over the cellular wireless network, indicated by antenna 110. Details are known for utilizing data channels (as distinguished from voice channels) over the network. There are also known methods to embed data in a voice channel call.

The probe messages travel through the cellular network 112, and may then traverse wired, cable, or other land-based networks 200. The connected car messages may be sent to a data center 114, for example, a resource managed by a fleet operator or vehicle manufacturer. The data center 114 may extract the probe data from the messages. The data center may then send anonymized data to a traffic technology analytics server 116. The analytics server 116 may implement the methods described below to utilize the probe data in order to recommend changes to better optimize the signal timing plan for one or more intersections where the probe data was collected. These changes or recommendations may be transmitted to city or county traffic management authorities 118 who have jurisdiction over the subject intersection(s). The local authorities may utilize this data to update the corresponding signal timing plan(s) 120.

Traffic Signals

Traffic signal timing plan optimization is important to local traffic engineering organizations in an effort to improve transportation efficiency, especially vehicular transportation, in their community or jurisdiction. Often, cities or counties are responsible for managing their traffic signals and related resources for the public good. While safety is always the primary consideration, moving traffic efficiently is of key importance to the public user base.

Timing plans can be developed for an isolated intersection or several intersections on a coordinated arterial. At a single intersection an adjustment may be made to the timing plan in response to a citizen complaint or agency staff member's observation regarding a specific problem. Field observation by agency staff is often critical to identifying localized problems and solutions. This can include minor adjustments to the detector settings or fine tuning to adjust the split and/or offset at the problem intersection for the time of day during which the problem was observed. This may also include adjustments to pedestrian and clearance intervals in response to a perceived safety problem. These types of adjustments are essential for effective signal system operation. They are restricted to that particular intersection and do not usually consider the impact the timing changes may have on nearby intersections. These adjustments are solely driven by a localized change in traffic conditions (and in some cases geometric conditions) or the enhancement of existing timing at a single intersection.

Figure 2:
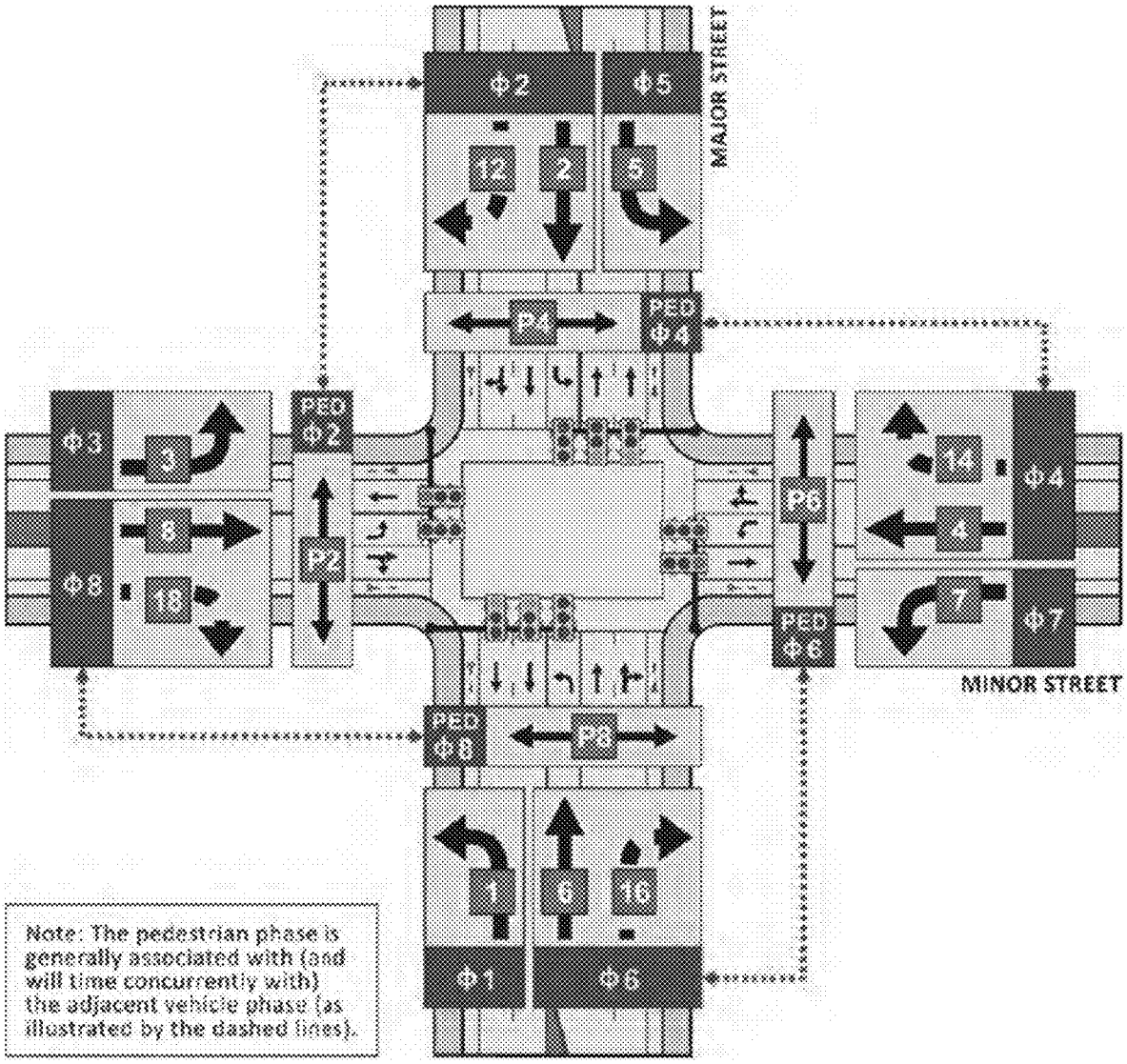
FIG. 2 PRIOR ART
FIG. 2 (prior art) is a diagram of an intersection defining lanes, movements and phases.

FIG. 2 illustrates an intersection, adapted from Signal Timing Manual, second ed., National Academies of Sciences, Engineering, and Medicine 2015. Diagram [5.1.1]. This diagram illustrates typical movement and phase numbering (with protected left turns). Movements describe user actions at an intersection. At a signalized intersection (with four approaches), it is possible to have twelve one-way vehicular movements and four two-way pedestrian movements. Each of these movements can be assigned a number for reference. The Highway Capacity Manual (HCM) assigns movement numbers as shown in FIG. 2 (illustrated by the gray squares). The HCM gives each right-turn movement its own number (separate from the through movement) by adding 10 to the adjacent through movement number. Note that a single movement can be accommodated by multiple lanes (e.g., through movement in two lanes), or multiple movements can be accommodated by a single lane (e.g., through/right-turn lane).

A traffic signal phase is a timing process, within the signal controller, that facilitates serving one or more movements at the same time (for one or more modes of users). A practitioner must assign phase numbers to the movements at a signalized intersection in order to begin selecting signal timing values. A typical four-legged intersection with protected left-turn movements (protected movements have the right-of-way over other movements) will generally follow the phase numbering shown in FIG. 2 with the Greek letter phi Φ meaning phase. (The pedestrian phases are omitted in this drawing for clarity. In practice they are of course an integral part of the control system.)

A cycle length is the amount of time required to display all phases for each direction of an intersection before returning to the starting point, or the first phase of the cycle. Cycle lengths are based on traffic volumes and work best within a certain range depending on the conditions of the intersection. See FIG. 6 for an illustration of cycle times relative to traffic volumes. A primary (but not the only) goal of signal timing is to find an optimum cycle length for the most efficiency. Typical cycle lengths may range from one minute to three minutes.

A split determines how much time each movement gets in a cycle. The split includes the green time and the clearance interval, or the time to clear the intersection, which includes the yellow and red lights. Clearance interval times are calculated based on speed limit, intersection widths, intersection grades, perception or start-up time, and acceleration rates. Clearance intervals are often referred as the change interval, when changing from one signal phase to the next. The clearance time in that sequence is also referred to as "loss time" due to vehicles coming to a stop or starting-up and the time that no vehicles are moving through the intersection.

Moving traffic efficiently in large part means minimizing delays at signaled intersections. Cars that are "stuck" at an intersection, say for more than one signal cycle (called a "phase failure"), is wasteful of time and fuel and, multiplied over thousands of users and thousands of intersections, the impact is substantial. Optimization of a timing plan generally means minimizing the overall or average delay experienced by users of the corresponding intersection.

Figure 6:
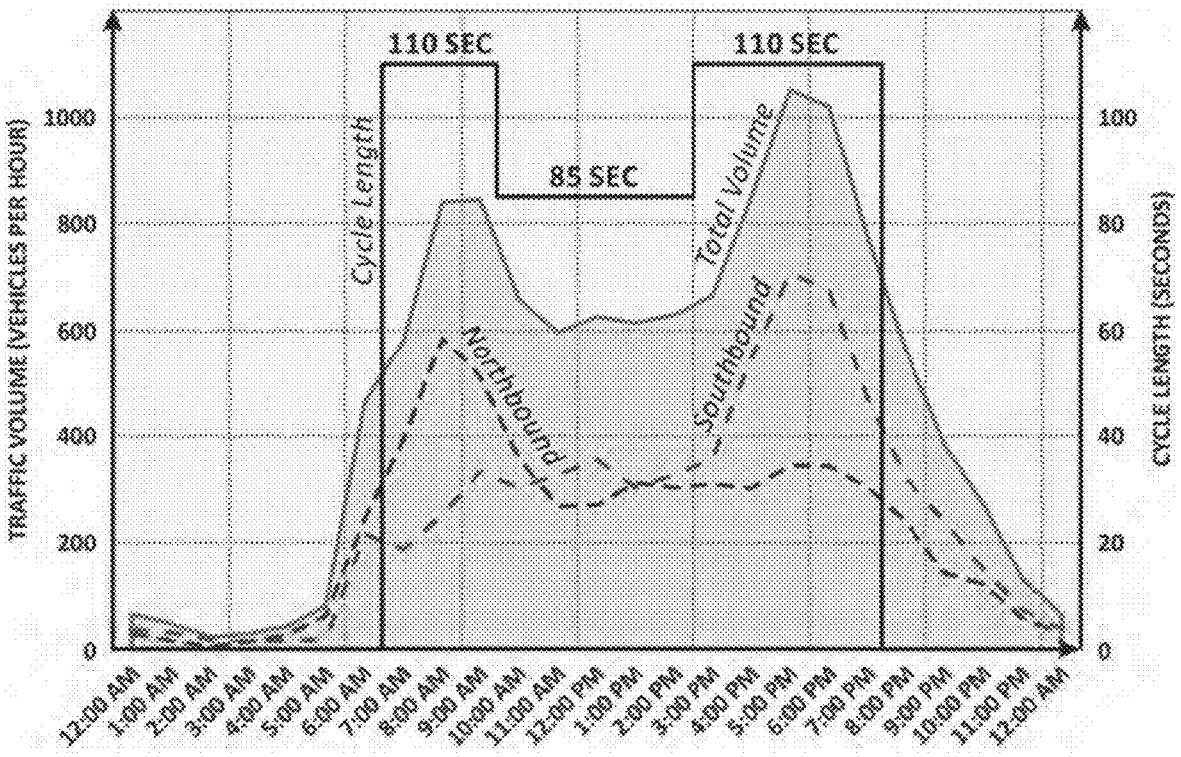
FIG. 6 PRIOR ART
FIG. 6 (prior art) is a typical graph of traffic volume over 24 hours.

FIG. 6 (prior art) is a typical graph of traffic volume over 24 hours. This graph illustrates how traffic volume varies substantially by hour of the day. The graph also shows the northbound and southbound traces, illustrating "rush hour" traffic in the morning going northbound and, in the afternoon-evening, in the southbound direction. The graph of FIG. 6 also illustrates changes in the signal cycle length to better accommodate the total traffic volume. During off-peak hours, this particular signal is either turned to side-street red flashing or "free-running" which means that there is no prescribed cycle length. Both are typical ways for operating a traffic signal during low-volume periods.

Delay is the difference in travel time that a user experiences between free-flow (unimpeded) conditions and current conditions. It is a primary measure in optimization models because it is easily quantified. It can also be used in models to estimate users' operating costs. However, incremental changes in delay at an intersection are less noticeable to roadway users than other mobility-related performance measures, such as number of stops or overall trip travel time. Importantly, it is also not readily measured in the field using prior art technology.

Delay at a signalized intersection can be the result of (1) signal control and timing, (2) queues that impede travel, or (3) factors such as bus blockages, parking maneuvers, and distracted drivers. Delay can ultimately be expressed in two ways:

1. Unit delay (seconds/vehicle), which is related to the user's perception of disutility at an intersection; or
2. Total accumulated delay (vehicle-hours), which is related more to the economic performance of an intersection. One vehicle-hour of delay is accumulated when one vehicle is delayed for a full hour, or 3600 vehicles are delayed for 1 second each, etc.

To minimize delay, properly adjusting the "green time" for each phase is one of several important variables. Existing methods for traffic signal timing plan optimization generally require three kinds of inputs:

1. Detailed junction geometry and lane grouping/phasing
2. Observed traffic volumes and relevant parameters (e.g. peak hour factor, heavy vehicle percentages and so on).
3. Basic signal controller settings There is existing commercial software that does the job with heavy labor input and subject to human errors, which requires labor intensive reviews from agencies.

Deriving Signal Timing Plan Optimization Input Data from Connected Vehicle Data Junction Geometry Data In some embodiments, the basic input to signal timing optimization of detailed junction geometries and lane grouping/phasing can be derived directly from MAP data. This is an industry standard message set. See, for example, Dedicated Short Range Communications (DSRC) Message Set Dictionary™ J2735_200911. This SAE Standard specifies a message set, and its data frames and data elements specifically for use by applications intended to utilize the 5.9 GHz Dedicated Short Range Communications for Wireless Access in Vehicular Environments (DSRC/WAVE, referenced in this document simply as "DSRC"), communications systems.

Although the scope of the Standard is focused on DSRC, this message set, and its data frames and data elements have been designed, to the extent possible, to also be of potential use for applications that may be deployed in conjunction with other wireless communications technologies. This Standard therefore specifies the definitive message structure and provides sufficient background information to allow readers to properly interpret the message definitions from the point of view of an application developer implementing the messages according to the DSRC Standards.

SPaT stands for Signal Phase and Timing. This too is an industry standard. MAP contains the topology (lanes, signal phases) of an intersection and approaches, and SPaT (signal phase and timing) contains the current signal status and the next predicted switch times. In an embodiment, our method is to leverage connected vehicle "probe" data to figure out the traffic volume for a time period and location, and then optimize the timing plan for that time period for the subject signal/lane/phase.

The FSC in general does not have volume data, for example from detectors, because not all movements are counted separately. Also, many detection zones (loops) are too long for counting of individual vehicles. Detectors are typically not helpful in the present context; detectors are installed to "detect" the presence of vehicles, not to count movements. Also, the data we require is historic and aggregated over a long period of time (for example, a month). Detectors provide only current, real-time information.

Connected Vehicle Data

Connected Vehicles or mobile devices, cross the intersection and leave the GPS traces within the traffic flow. These probe data, or typically called floating car data (FCD) when being used as a hired service, can be aggregated periodically, for example, every 15-minutes or every hour, and can include but are not limited to the following:

Experienced delays

Experienced queue lengths (e.g., $85^{th}$ percentile)

Probe data volumes

Deriving Traffic Volumes from Connected Vehicle Data and Signal Timing Parameters Existing signal optimization methods use manually observed traffic volumes and the following formula to calculate the delays:

Equation 1 $$d = d_1\,(PF) + d_2 + d_3$$

Equation 2 $$d_1 = \frac{C*[I-(g/C)]^2}{2*[I-(g/C)*\min(1,X)]}$$

Equation 3 $$d_2 = 900*T*\left\{(X-1)+\sqrt{(X-1)^2+\frac{8*k*I*X}{cap*T}}\right\}$$

Variables and constants in the above equations are the following:

d=Control Delay (sec/veh).

d1=Uniform delay (sec/veh).

d2=Incremental delay (sec/veh).

d3=Initial queue delay (sec/veh).

PF=Progression adjustment factor.

C=Cycle Length (secs).

g=Effective green time for the lane group (secs).

X=Volume/capacity ratio for the subject lane group.

k=Actuated control factor.

I=Upstream filtering factor.

v=Volume per hour (veh/hr).

cap=Capacity (sat*g/c) for the through lane group (veh/hr).

T=Duration of analysis period (hr).

(Source: Traffic Analysis Toolbox Volume VI: Definition, Interpretation, and Calculation of Traffic Analysis Tools Measures of Effectiveness, https://ops.fhwa.dot.gov/publications/fhwahop08054/sect4.htm 9 accessed Feb. 14, 2018)

From the above equation, we back-calculate the key input parameter, traffic volumes, from the connected vehicle data and existing signal timing parameter data. The equation can be solved analytically or numerically. With the above input complete, existing signal timing plan optimization toolboxes can be employed to derive the optimal timing plans for the selected target period.

Figure 5:
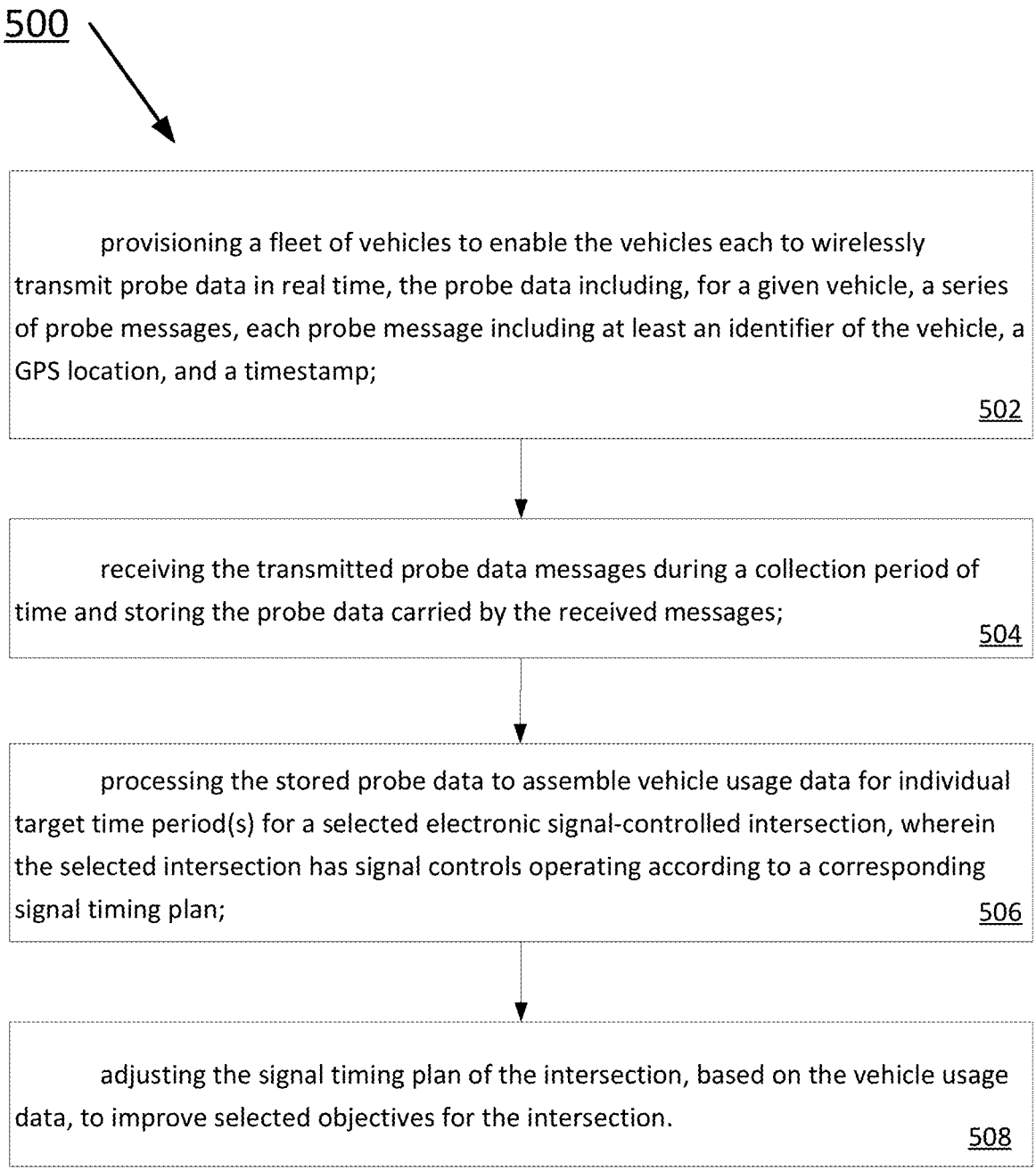
FIG. 5 is a simplified process diagram consistent with the present disclosure.

FIG. 5 is a simplified flow diagram summarizing a process or method 500 according to some embodiments of this disclosure. In the figure, it illustrates the steps of: provisioning a fleet of vehicles to enable the vehicles each to wirelessly transmit probe data in real time, the probe data including, for a given vehicle, a series of probe messages, each probe message including at least an identifier of the vehicle, a GPS location, and a timestamp, block 502; receiving the transmitted probe data messages during a collection period of time and storing the probe data carried by the received messages, block 504; processing the stored probe data to assemble vehicle usage data for individual target time periods for a selected electronic signal-controlled intersection, wherein the selected intersection has signal controls operating according to a corresponding signal timing plan, block 506; and adjusting the signal timing plan of the intersection, based on the vehicle usage data, to improve selected objectives for the intersection, block 508.

For example, a collection period may extend over a month or more. This is to improve accuracy by collecting a larger number of samples for each target period. A "target period" is typically a given day of the week and an hour of that day. Or, days may be grouped into weekdays and weekend days. There may be another group of target periods for holidays. During each day, data should be collected for each hour, for example, and averaged over the collected probe data corresponding to that particular hour. In some embodiments, the data may be processed using finer granularity such as 15- or 30-minute target time periods.

Figure 4:
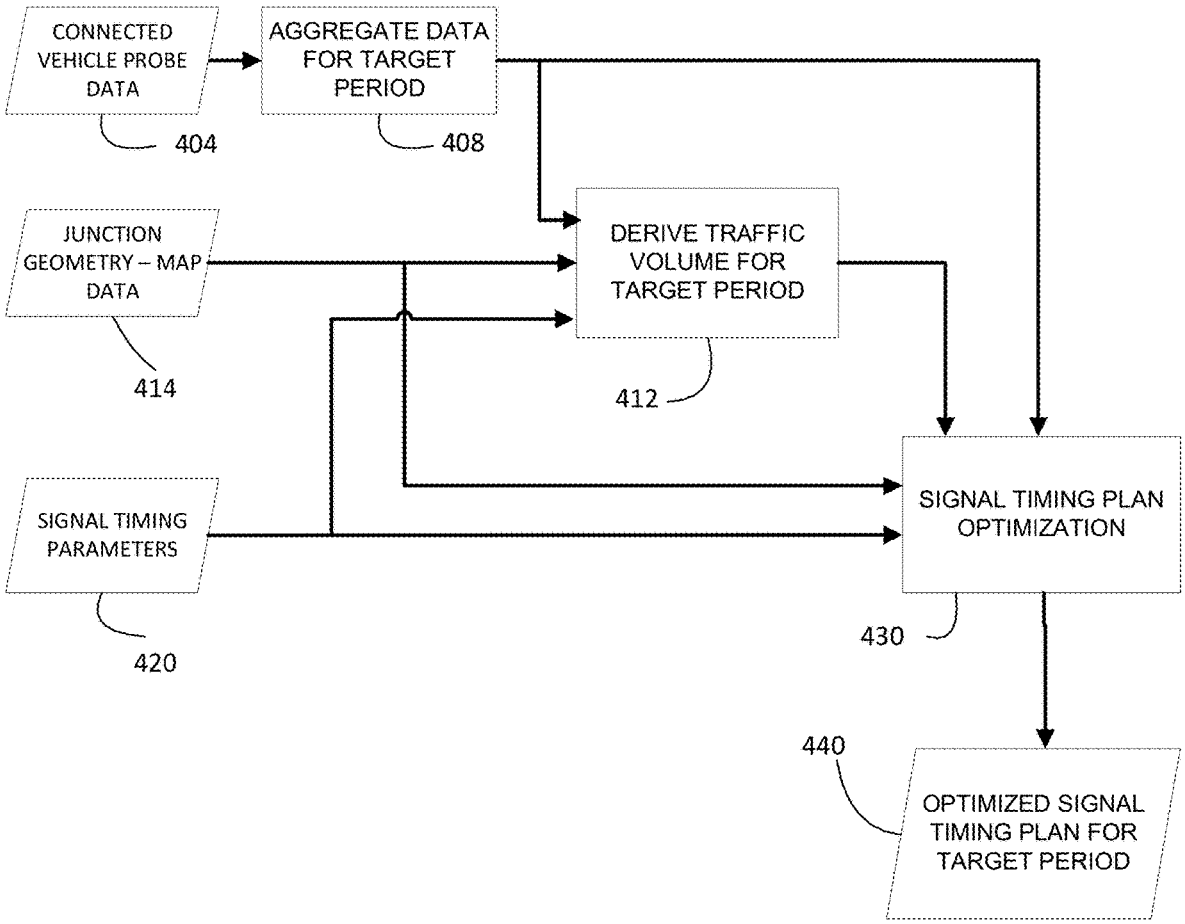
FIG. 4 is simplified example of a workflow diagram consistent with the present disclosure.

A simplified example workflow is shown in FIG. 4. In the figure, it illustrates conceptually receiving connected vehicle probe data, block 404. The probe data rate may be, for example, on the order of one message per second from each vehicle. The message includes an identifier, a current GPS location and timestamp. The GPS location is compared to traffic signal location data to identify a location, particularly an intersection, that the transmitting vehicle is approaching or is in. The GPS data has sufficient resolution to determine the specific location of the vehicle, identifying which lane or movement it is in or approaching (see below). The probe data is collected over a collection period of time, and then aggregated for individual target time period(s), block 408. The collection period is preferably several weeks.

Junction geometry and MAP data is acquired or accessed, block 414. MAP data provides geographic information about the intersection and approach geometry. And the current timing plan signal timing parameters are accessed, block 420. These resources enable mapping a vehicle GPS location to a specific approach, lane, etc. The aggregated data from 408, the junction geometry and MAP data 414 and the signal timing parameters from block 420 are all utilized to derive traffic volume for the target time period at the selected intersection, block 412. This traffic volume data, based on connected vehicles probe data, is far more accurate and current than the data traditionally acquired manually, for example, by workers using counters. Other known techniques to acquire traffic volume data, for example, using elevated cameras and machine vision, are costly to acquire, install and maintain.

A Connected Vehicle service such as the Personal Signal Assistant® predicted traffic signal information service may include signal status events that affect normal operations (such as TSP (Transit Signal Priority) events, or ambulance/fire truck/train preemptions). At the same time, the data service uses the signal timing plan information as input. Therefore, a data cleaning procedure can be utilized to prepare the signal timing plan information as the basis for signal timing optimization.

The resulting derived traffic volume data is input, block 412, is input to a signal timing plan optimization module, block 430, which is preferably implemented in software. The optimization module also receives as input data the aggregated data from block 408 and the junction geometry (block 414) and the signal timing parameters (block 420).

Figure 3:
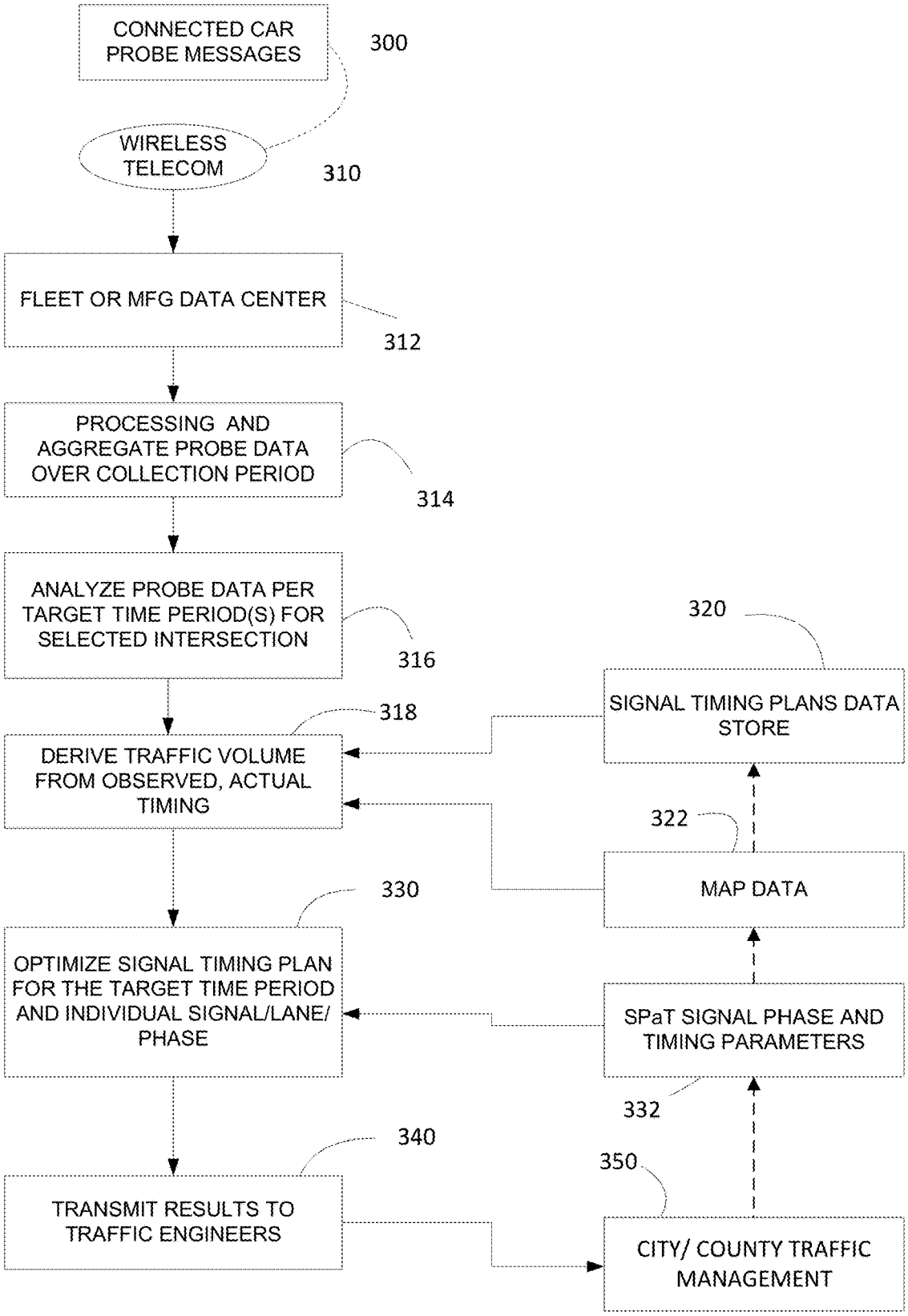
FIG. 3 is a simplified conceptual diagram of a process consistent with the present disclosure.

FIG. 3 is a simplified conceptual diagram of a process consistent with the present disclosure. This diagram illustrates connected vehicle probe messages 300 received over a wireless network 310 by a fleet or vehicle manufacturer data center 312. The data center may process the received messages, block 314, to extract probe data and sort it by intersection. The probe data is analyzed per time period(s) for each selected intersection, block 316. The processing and analysis of probe data—to assemble data sorted by intersection, approach, time period, etc. may be done by the data center 312. In other embodiments, raw probe data may be supplied by the data center 312 to another entity which may do the necessary processing.

The analyzed data may be utilized by a third-party vendor or cloud service, block 318, to derive actual traffic volume from the probe data, utilizing the corresponding signal timing plan from a data store 320, MAP data 322 and SPaT data 332. The timing plan, MAP data and SPaT data may be maintained by a local traffic control authority 350. The derived volume is used to determined adjustments to the signal timing plan per individual period, lane and phase, block 330. The results may be transmitted, block 340, to the local city/country traffic management authorities.

Variations to the Method

Other variations or enhancement of the described methodology may also include putting the method to a service that continuously runs in the background as a cloud service and recommending timing plans by demand or as needed.

In an alternative embodiment, probe data can be collected through the DSRC radio system rather than over the cellular network. This method will become more widely available as DSRC is deployed at more intersections.

Most of the equipment discussed above comprises hardware and associated software. For example, the typical electronic device is likely to include one or more processors and software executable on those processors to carry out the operations described. We use the term software herein in its commonly understood sense to refer to programs or routines (subroutines, objects, plug-ins, etc.), as well as data, usable by a machine or processor. As is well known, computer programs generally comprise instructions that are stored in machine-readable or computer-readable storage media. Some embodiments of the present invention may include executable programs or instructions that are stored in machine-readable or computer-readable storage media, such as a digital memory. We do not imply that a "computer" in the conventional sense is required in any particular embodiment. For example, various processors, embedded or otherwise, may be used in equipment such as the components described herein.

Memory for storing software again is well known. In some embodiments, memory associated with a given processor may be stored in the same physical device as the processor ("on-board" memory); for example, RAM or FLASH memory disposed within an integrated circuit microprocessor or the like. In other examples, the memory comprises an independent device, such as an external disk drive, storage array, or portable FLASH key fob. In such cases, the memory becomes "associated" with the digital processor when the two are operatively coupled together, or in communication with each other, for example by an I/O port, network connection, etc. such that the processor can read a file stored on the memory. Associated memory may be "read only" by design (ROM) or by virtue of permission settings, or not. Other examples include but are not limited to WORM, EPROM, EEPROM, FLASH, etc. Those technologies often are implemented in solid state semiconductor devices. Other memories may comprise moving parts, such as a conventional rotating disk drive. All such memories are "machine readable" or "computer-readable" and may be used to store executable instructions for implementing the functions described herein.

A "software product" refers to a memory device in which a series of executable instructions are stored in a machine-readable form so that a suitable machine or processor, with appropriate access to the software product, can execute the instructions to carry out a process implemented by the instructions. Software products are sometimes used to distribute software. Any type of machine-readable memory, including without limitation those summarized above, may be used to make a software product. That said, it is also known that software can be distributed via electronic transmission ("download"), in which case there typically will be a corresponding software product at the transmitting end of the transmission, or the receiving end, or both.

It will be obvious to those having skill in the art that many changes may be made to the details of the above-described embodiments without departing from the underlying principles of the invention. The scope of the present invention should, therefore, be determined only by the following claims.

The invention claimed is:

1. A method comprising:

provisioning a fleet of vehicles to enable the vehicles each to wirelessly transmit probe data in real time, the probe data including, for a given vehicle, a series of probe messages, each probe message including at least an identifier of the vehicle, a GPS location, and a timestamp;

receiving the transmitted probe data messages over a collection period of time and storing the probe data carried by the received messages;

processing the stored probe data to assemble vehicle usage data over at least one target time span for a selected electronic signal-controlled intersection, wherein the selected intersection has signal controls operating according to a corresponding signal timing plan; and adjusting the signal timing plan of the intersection, based on the vehicle usage data, to improve selected objectives for the intersection.

2. The method of claim 1 wherein the signal timing plan includes, for at least one movement of the intersection, data defining signal timing and phasing for the movement, and adjusting the signal timing plan based on the probe data includes adjusting, for the at least one movement of the intersection, at least one of the movement signal timing and phasing.

3. The method of claim 2 wherein the data defining signal timing and phasing includes a cycle length and green times per phase, and adjusting the signal timing plan based on the probe data includes adjusting at least one of the cycle length and green times per phase.

4. The method of claim 2 including receiving the transmitted probe data messages, from each one of the vehicles, at a rate of approximately once per second.

5. The method of claim 1 wherein processing the stored probe data includes:

selecting an intersection;

gathering the stored probe data for that intersection;

selecting a target time period;

assembling the probe data collected during the target time period at the selected intersection over the collection period to form the vehicle usage data.

6. A method comprising:

selecting an intersection that has an electronic traffic control signal and has a signal timing plan_for controlling the electronic traffic signal;

collecting probe data over a target period of time from connected vehicles that use the selected intersection;

aggregating the collected probe data to form average delay for each lane group of the selected intersection during the target time period;

based on the average delays for each lane group, determining an average vehicle volume per lane group during the target time period; and optimizing the signal timing plan based on the determined average vehicle volumes so as to minimize user delay at the selected intersection.

7. The method of claim 6 wherein the signal timing plan includes signal timing and phasing and optimizing the signal timing plan based on the probe data includes adjusting at least one of the signal timing and phasing.

8. The method of claim 6 wherein optimizing the signal timing plan based on the probe data includes adjusting, for at least one movement of the traffic signal, at least one of the movement signal timing and phasing.

9. The method of claim 6 wherein optimizing the signal timing plan based on the probe data includes adjusting at least one of the cycle length and green times per phase.

10. The method of claim 6 wherein collecting probe data from connected vehicles includes receiving a message from each vehicle, the message including a GPS location of the vehicle and a corresponding time stamp, at a rate of approximately one message per second.

11. A method comprising:

selecting an intersection that has an electronic traffic control signal controlled according to a signal timing plan;

collecting probe data over a target period of time from connected vehicles that use the selected intersection;

aggregating the probe data over the target period of time for a given lane group and phase of the intersection to form aggregated probe data;

deriving junction topologies (lanes/signal phasing) from MAP data of the intersection;

acquiring signal phase and timing parameters containing a current status of the traffic control signal;

deriving traffic volume for the target period based on the aggregated probe data, the junction geometry/MAP data, and the signal timing parameters;

optimizing the signal phase and timing parameters to form results based on (a) the aggregated probe data, (b) the derived traffic volume, (c) the junction geometry/MAP data, and (d) the signal timing parameters;

and then update the signal timing plan for the target time period based on the results of the optimizing step.

12. The method of claim 11 wherein the target time period is one or more weeks.

13. The method of claim 12 including aggregating the probe data for each 15-minute interval during the time period.

14. The method of claim 11 including aggregating the probe data periodically during the time period.

15. The method of claim 11 including analyzing the probe data to log user delays experienced at the intersection.

16. The method of claim 15 including:

comparing the logged user delays to a predetermined threshold value; and responsive to the logged user delays exceeding the threshold value, triggering an alarm message.

17. The method of claim 16 including automatically transmitting the alarm message to a local government agency responsible for operation of the electronic traffic control signal that controls the selected intersection.

18. The method of claim 11 including logging abnormal signal status events that affect normal operations (TSP events, or ambulance/fire truck/train preemptions); and cleaning the probe data to remove effects of the abnormal signal status events.

19. A method comprising:

selecting an intersection that has an electronic traffic control signal and has a signal timing plan for controlling the electronic traffic signal;

collecting probe data over a target period of time from connected vehicles that use the selected intersection;

aggregating the collected probe data to form average delay for each lane group of the intersection during the target time period;

based on the average delays for each lane group, determining a vehicle volume per lane group during the target time period; and utilizing the determined vehicle volumes to optimize the signal timing plan.

20. The method of claim 19 and further comprising:

providing the optimization data to a software service.

21. The method of claim 20 wherein the software service runs continuously as a cloud service and provides recommended timing plans upon demand.

* * * * *